United States Patent [19]

Baughman et al.

[11] 4,406,247

[45] Sep. 27, 1983

[54] ADHESIVE DISPENSING SYSTEM

[75] Inventors: Richard C. Baughman, Geneseo; Stephen J. Flamini, Rochester, both of N.Y.

[73] Assignee: Eastman Kodak Company, Rochester, N.Y.

[21] Appl. No.: 403,755

[22] Filed: Jul. 30, 1982

[51] Int. Cl.[3] ..... B05C 21/00

[52] U.S. Cl. ..... 118/684; 156/295; 156/356; 156/364; 156/563; 156/578; 118/679; 118/681; 118/678; 118/694; 222/14; 222/71; 222/65; 222/66; 222/59

[58] Field of Search ..... 222/14, 71, 65, 66, 222/59, 108, 23; 118/679, 681, 684, 694, 678

[56] References Cited

U.S. PATENT DOCUMENTS

| | | | |
|---|---|---|---|
| 3,322,957 | 5/1967 | Scoggin | 222/66 X |
| 3,341,073 | 9/1967 | Arps et al. | 222/66 X |
| 3,739,745 | 6/1973 | Turpin | 118/694 |
| 3,768,439 | 10/1973 | Schweitzer | 118/679 X |
| 3,940,019 | 2/1976 | Kross et al. | 222/66 |
| 4,121,535 | 10/1978 | Roberts et al. | 118/694 |

OTHER PUBLICATIONS

"Binding Apparatus," Research Disclosure, 3/1981, S1681, No. 203, 20341.

*Primary Examiner*—Shrive P. Beck

*Attorney, Agent, or Firm*—G. Herman Childress

[57] ABSTRACT

An adhesive applicator has a nozzle through which adhesive can be dispensed to sheets of a set as the sheets are driven seriatim past the nozzle. Adhesive is furnished in a cartridge which is pressurized so that the adhesive is delivered from the cartridge to the nozzle under pressure. A valve controls the flow of adhesive from the nozzle, and the valve is under control of a logic and control unit. The logic and control unit receives signals from various sensors or detectors indicating, inter alia, the presence of an adhesive cartridge, the level of adhesive in the cartridge, the flow of adhesive from the nozzle, and the amount of adhesive in a collection bottle which receives surplus adhesive dispensed from the nozzle but not applied onto a sheet. The logic and control unit is capable of operating the valve that controls flow of adhesive from the nozzle so that adhesive is selectively dispensed from the nozzle to all but one sheet of a set of sheets. A purge cycle is initiated if adhesive does not flow from the nozzle when commanded to flow by the logic and control unit.

9 Claims, 3 Drawing Figures

ADHESIVE DISPENSING SYSTEM

CROSS REFERENCE TO RELATED APPLICATION

Reference is made to the co-pending, commonly assigned U.S. patent application Ser. No. 380,966, entitled *BINDING APPARATUS AND METHOD* filed on May 24, 1982, in the names of R. C. Baughman, D. S. Bump and C. R. Hubbard.

BACKGROUND OF THE INVENTION

This invention relates to adhesive dispensing systems of the type used for applying adhesive to a set of sheets that are to be bound together into a booklet.

It is known to bind together sheets of a booklet by applying adhesive to the edge of a set of sheets. This is disclosed, for example, in U.S. Pat. No. 4,009,071 entitled *SHEET BINDING APPARATUS* which issued on Feb. 22, 1977 in the names of Snellman et al. In accordance with the disclosure and the Snellman et al patent, sets of sheets are formed in a sorter/collator or the like and jogged to align the sheet edges. Then glue is applied to an endless belt and the belt is moved into engagement with edges of the sheets in the various compartments of the sorter, collator or the like to deposit glue on the edges of the sets of sheets. The Snellman et al patent discloses a control system for operation of the sheet binding apparatus. Similar disclosures of binding apparatus are found in U.S. Pat. Nos. 4,077,831; 4,116,750; and 4,145,241.

U.S. Pat. No. 3,404,880 issued on Oct. 8, 1968 in the names of H. R. Porter, Jr. et al for a *GLUING ATTACHMENT FOR A COLLATING MACHINE.* The apparatus disclosed in the Porter Jr. et al patent comprises a collator which holds stacks of sheets adjacent to a conveyor, and sheet transfer means which transfers individual sheets onto the conveyor. As each sheet is lifted from the stack and placed on the conveyor a small spot of glue is applied to the sheet so that when the sheets are assembled into a booklet the glue is effective to hold the sheets together.

U.S. Pat. No. 3,908,869 entitled *METHOD AND APPARATUS FOR DISPENSING AIR-CURABLE VISCUS MATERIALS,* which issued on Sept. 30, 1975 in the name of W. A. Little, discloses formation of a gasket by dispensing a rubber-like material through a nozzle that is driven in a path over a support for the gasket. The rubber-like material is delivered from a container to the nozzle through a dispensing system comprising a pump and a pressure accumulator. Apparatus is disclosed for preventing drying out or clogging of the rubber-like material in the nozzle.

It is also known to pressurize containers of liquid to force the flow of liquid out of the container in response to opening of a valve at a remote location. For example, U.S. Pat. No. 3,228,413 to Stevens shows a device for tapping a keg of beer wherein a passageway permits pressurized gas to enter the beer keg and beer can flow from the pressurized keg through a second passage and then through a valve into a glass or other container.

Certain problems are presented by automated sheet binding apparatus used for producing booklets in an on-line binding apparatus and method as disclosed in the beforementioned U.S. Pat. application Ser. no. 380,966 entitled *BINDING APPARATUS AND METHOD.* For example, such binding apparatus and method can receive sets of sheets wherein the sheets are fed seriatim from a copier/duplicator or the like and delivered directly to the binding apparatus. The individual sheets must be quickly fed through the binder, have adhesive applied thereto, assembled into sets with the adhesive between adjacent sheets, and a completed booklet discharged to a tote tray so that sheets of another set can immediately be received for forming another booklet. In addition, such apparatus may be operated by persons with very little training; thus it is desireable that the apparatus be essentially automatic in its operation. At the same time, it is important for the operator to be signaled in the event there is an inadequate supply of adhesive, in the event adhesive is not being dispensed onto sheets of paper as required, and to signal the operator in the event an overflow container adapted to receive excess adhesive becomes full. Moreover, it is important that the adhesive dispensing system for such binding apparatus and method be at least partially self-testing and, to some extent, even be self-correcting. This avoids the need for expensive and time consuming service calls and also avoids unproductive downtime for the apparatus.

SUMMARY OF THE INVENTION

In accordance with the present invention an adhesive dispensing system is provided including an adhesive applicator having a nozzle through which adhesive can be dispensed. A container is provided for holding a supply of adhesive and the upper portion of the adhesive container is pressurized. A fluid passage is provided from the lower portion of the container to the adhesive applicator. Valve means controls the flow of adhesive from the container to the nozzle of the applicator. Sensing means detect the presence of adhesive in the container at a level above the lower end of the fluid passage in the container and the flow of adhesive from the nozzle. Control means is coupled to the valve means, the sensing means and the detecting means for operating the valve means when the sensing means senses the presence of adhesive and for stopping the dispensing system if the detecting means does not detect the flow of adhesive from the nozzle a predetermined time interval after the valve means is operated. In a preferred embodiment of the invention a purge cycle is initiated in the event adhesive does not flow from the nozzle when it should be flowing. Also, further sensors and or detectors can be provided for detecting the presence of the adhesive container and for detecting when an overflow bottle or container for receiving excess adhesive flowing from the nozzle has reached a predetermined level.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present invention is particularly useful in connection with a binding apparatus and method as disclosed in the before-mentioned copending U.S. patent application Ser. No. 380,966, entitled *BINDING APPARATUS AND METHOD.* Accordingly, the following general description of portions of the binding apparatus and method in such application will facilitate an understanding of the present invention.

Figure 1:
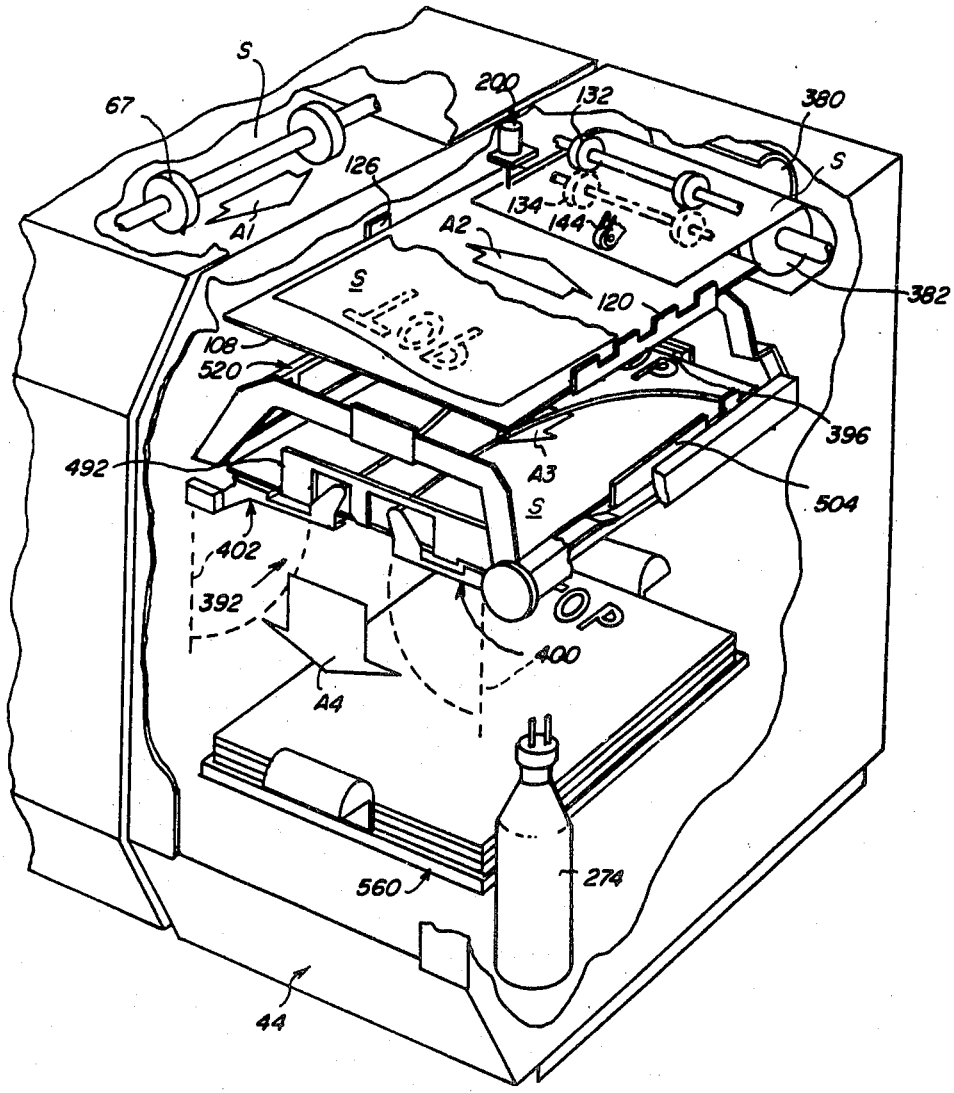
FIG. 1 is a perspective view of binding apparatus incorporating an adhesive dispensing system of the present invention with portions of the apparatus being cut-away to facilitate understanding of the apparatus.

FIG. 1 of the drawings illustrates a binder generally designated 44 which is described in detail in the before-mentioned patent application. The binder is adapted to receive one or more sets of copy sheets S that are to be bound together into booklets using an adhesive material. The sheets are delivered to the binder by drive apparatus including sets of drive rollers and pressure rollers, including the rollers shown at 67 in FIG. 1. A set of sheets to be formed together into a booklet will be delivered to the binder in a particular page sequential order. For example, preferably the sheet containing the last page of a set of sheets will be delivered first and the first page of the set of sheets will be delivered last. Thus the sheets are fed seriatim beginning with the last sheet or page of a booklet and ending with the first sheet or page of a booklet.

As copy sheets S enter the binder they are traveling in a left-to-right direction as shown by arrow A1 and as viewed from the front of the binder. The sheets S then drop downwardly onto an alignment tray 108. During movement in direction A1 the trailing edge of the sheet is the side edge that is to be bound to other sheets. The sheets are delivered to the tray so that the top of a sheet is near the front of the binder and with the copied information on simplex (one-sided) copy sheets being on the bottom face of the sheet and thus facing downwardly, as shown in FIG. 1. When duplex (two-sided) copy sheets are delivered to the binder, the information on the bottom face of the sheet normally comprises the odd page number of the sheet or the page that is first in reading the document.

After the trailing edge of the sheet enters tray 108 it is engaged by a side jogger 126 and urged to the right against a side guide 120. Then a puck drive mechanism 144 is swung from a storage position above tray 108 to an operating position in engagement with the sheet in tray 108. The drive mechanism immediately drives the sheet toward the rear of the binder and into the nip between pairs of drive rollers 132 and idler rollers 134. Promptly after the sheet enters the nip between the rollers 132, 134, the puck drive mechanism 144 is returned to its raised position so that the next sheet can be delivered to the tray 108.

Puck drive mechanism 144 and the rollers 132, 134 drive the left side edge of the sheet past an adhesive applicator generally designated 200. The direction of movement of the sheet at this time, as illustrated by arrow A2 in FIG. 1, is perpendicular to the direction of movement indicated by arrow A1. The first sheet of a booklet set delivered to tray 108 (which ordinarily is the last sheet or a back cover of the set) does not receive any adhesive as it passes the applicator 200.

Immediately after the first sheet passes the applicator, and just before the second sheet of a set reach the applicator, a liquid adhesive begins flowing through the applicator in a constant stream. The flow of adhesive is under control of the dispensing system of the present invention. The flow of adhesive continues without interruption until the second sheet completely passes the applicator, thereby applying a continuous line of adhesive to the upper surface of the sheet from the bottom edge to the top edge of the sheet. Adhesive flow is stopped immediately after the trailing edge of the second sheet passes the applicator. This on-off operation of the applicator is repeated until a stripe of adhesive is applied to all sheets of a set of copy sheets after the first sheet of the set. By way of example, the flow of adhesive can be initiated about twenty milliseconds before a sheet reaches the applicator nozzle and terminated about twenty milliseconds after a sheet passes the nozzle. This control of the flow of adhesive to all but the first sheet will be repeated for all subsequent sets of copy sheets delivered to the binder.

The first and/or last sheet can be cover sheets for a booklet. If a second (top) cover sheet is provided, adhesive also is applied to that sheet.

Sheets driven from tray 108 and past applicator 200 then travel along a curved sheet guide 380 and between a set of rollers, one of which is shown at 382. This inverts the sheet and delivers it to an assembly tray 392. The tray has two pivoted portions 400, 402. When a sheet enters the assembly tray 392, it is traveling in a direction, illustrated by arrow A3 in FIG. 3, which is opposite to the direction A2 of the sheets leaving tray 108. Sheets enter the tray 392 with information copied onto simplex copy sheets facing upwardly and with the top of the sheet near the rear of the tray. As a sheet enters the tray 392, its rear (top) edge is engaged by a jogger 396 which urges the leading edge of the sheet firmly against a sheet registration member 492. Also, a side jogger 504 engages one side edge of each sheet and urges it against the surface of another registration member (not shown) at the side of tray 392 opposite from jogger 504.

A pressure bar assembly 520 is normally in its raised position, as illustrated in FIG. 1 of the drawings, where it is out of the path of sheets entering tray 392. After each group of a few sheets (e.g., 2–4 sheets) is delivered to the assembly tray 392, the pressure bar assembly is driven downwardly into engagement with the sheets in the assembly tray. The bar engages the upper surface of the top sheet along a line directly overlying the adhesive on the lower surface of the sheet. Pressure bar assembly 520 thus periodically compresses the sheets stacked in the assembly tray in the area of the adhesive to effect a firm bond between adjacent sheets. The pressure bar assembly 520 also presses downwardly on the uppermost sheet after the last sheet of a set is delivered to the assembly tray. This last sheet of the set normally is the first sheet or cover sheet of a copy set.

When a complete set of copy sheets has been assembled and bound together into a booklet in the tray 392, tray portions 400, 402 are swung from their generally horizontal positions shown in solid lines in FIG. 1 to their generally vertical positions as diagramatically shown by the dotted lines in FIG. 1. This opens the bottom of the tray and allows the completed booklet to drop through the assembly tray and onto a tote tray 560 located beneath the assembly tray. Such movement of the booklet is illustrated by arrow A4 in FIG. 1. A more comprehensive description of the binder apparatus 44 described hereinbefore can be found in the referenced copending patent application.

Figure 2:
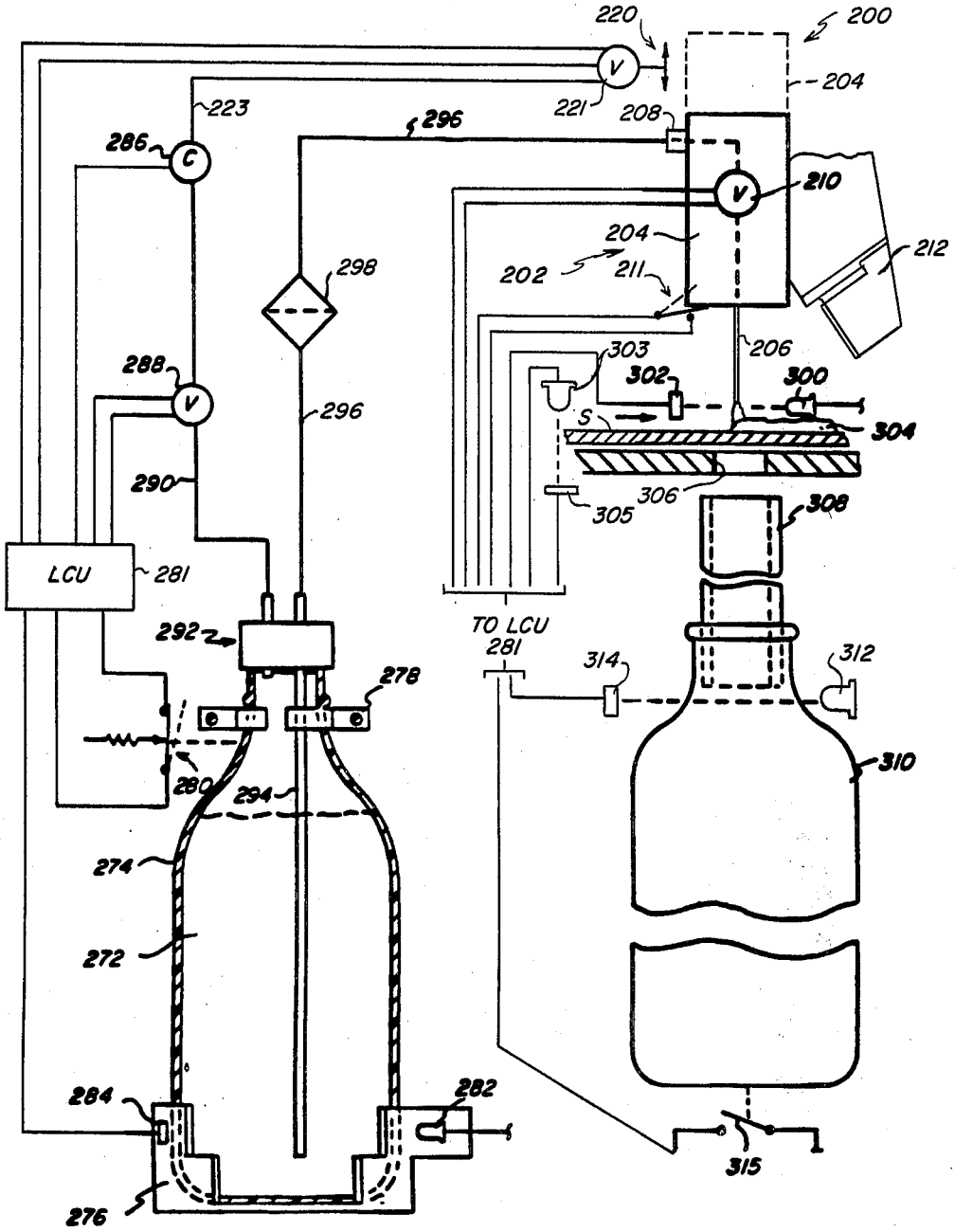
FIG. 2 is a fragmentary detailed view of the adhesive dispensing system of the present invention.

Referring now to FIG. 2 of the drawings, adhesive 272 for the adhesive dispensing system of this invention is provided in an adhesie cartridge 274. Cartridge 274 is a container formed of a high strength material which allows the cartridge to be pressurized for dispensing of the adhesive. The lower portion of the cartridge is seated in a cartridge holder 276 and the upper portion of the cartridge is snapped into a retainer 278. When the cartridge is placed in the retainer 278, the cartridge closes a normally-open switch 280, thereby producing a signal to a logic and control unit (LCU) 281 indicating a cartridge is present in the retainer. Also, an emitter 282 and detector 284 in holder 276 provide a signal to the LCU 281 indicating that the level of adhesive 272 in the cartridge is above or below the lower end of the cartridge. This signal allows the LCU to signal the machine operator to replace the cartridge when only a small amount of adhesive remains in the cartridge 274.

Air or other gas under pressure is introduced into the upper portion of the cartridge above the level of the adhesive 272 to pressurize the cartridge. This may be accomplished by providing air from a compressor 286 forming part of the binder apparatus. A solenoid operated control valve 288 can be provided in a line 290 leading from the compressor to the cartridge in order to control the flow of air to the cartridge. Compressor 286 and valve 288 are operated by the binder LCU. The air under pressure is introduced into the cartridge through a cartridge closure and interface generally designated 292. This interface is described and illustrated in detail in the beforementioned application. For an understanding of the system of this invention it is sufficient to understand that air under pressure is introduced through the interface into the upper portion of the cartridge above the level of adhesive 272, thereby to pressurize the cartridge. This allows adhesive to be forced through a conduit 294 that extends from the lower portion of the cartridge through the interface 292 to the outside of the cartridge where it is connected to a conduit 296. The lower end of conduit 294 is below the path between the emitter detector 282, 284 so that the operator can be signaled when the adhesive level approaches the lower end of conduit 294 and before the system is unable to deliver adhesive. A filter 298 preferably is provided in conduit 296 to remove particles in the adhesive that are larger than a predetermined size. For example, the filter may remove any particles larger than 100 microns.

Adhesive applicator 200 compises a nozzle assembly generally designated 202 that can be moved between a storage position, shown in dotted lines in FIG. 2, and an adhesive applying position shown in solid lines. The nozzle assembly comprises a housing 204 and a nozzle tip end 206 through which adhesive is dispensed. Adhesive is supplied to the nozzle assembly through an inlet port 208. Conduit 296 is connected to port 208. The nozzle assembly 202 preferably includes a solenoid operated valve 210 which is under control of the logic and control unit 281. Valve 210 controls the flow of adhesive through the applicator in response to signals from the LCU.

A sump 212 is provided. When the nozzle assembly is in its storage position shown in dotted lines, the sump is located to receive the tip end 206 of the nozzle. The sump holds an adhesive solvent. As the nozzle assembly is moved from its storage position to its solid-line operating position, the end 206 is removed from the sump and the sump is swung to the side away from the path of movement of the nozzle assembly to the solid line position shown in FIG. 2. The sump and a mechanism for moving it is described in more detail in the before-mentioned patent application. When the nozzle tip end 206 is in the sump any material in the lower end of the nozzle will not dry out or clog the end of the nozzle. A suitable detector, such as a normally open mechanical switch 211, senses the presence of the applicator at its operating position and provides a signal to the LCU 281.

A mechanism schematically shown at 220 is provided for moving assembly 202 and the sump 212 between the storage and operating positions. For example, mechanism 220 may comprise a mechanical linkage driven by a pneumatic cylinder as disclosed in detail in the previously mentioned application. The supply of air to mechanism 220 can be controlled by a solenoid operated valve 221 controlled by LCU 281. Air under pressure is provide from compressor 286 to valve 221 and mechanism 220 through a conduit 223. Mechanism 220 is described in more detail in the before-mentioned copending patent application.

The solenoid operated valve 210 in the applicator assembly 202 controls the flow of adhesive through the nozzle end 206 as it is applied onto a sheet S. The flow of adhesive from the end 206 of the nozzle is detected by a suitable sensor. For example, the sensor can comprise an emitter 300 and detector 302 located on opposite sides of the adhesive path from the nozzle to a sheet S. Alternatively, adhesive flow can be sensed by a pressure differential sensor in conduit 296. The sensor provides a signal to the LCU 281 indicating that adhesive is (or is not) flowing from the nozzle. If adhesive is not flowing from the applicator at any time during movement past the applicator of the second copy sheet through the last copy sheet of a set of copy sheets, the LCUs will stop the binder and signal the machine operator or initiate the purge cycle described later.

The LCU tracks the stream of sheets through the binder. This can be accomplished by sensors located along the path for sheets through the binder. For example, an emitter 303 and detector 305 (FIG. 2) located on opposite sides of the sheet path across tray 108 just ahead of the applicator 200 will provide signals to the LCU indicatling the movement of sheets to the applicator. Other similar sensors can be placed at various locations along the sheet path.

During normal operation the adhesive system does not apply adhesive to the first sheet of a set of sheets fed past the applicator nozzle. However, for each subsequent sheet of the set of sheets, adhesive flows from the end 206 of the applicator assembly during a time interval beginning just before the leading edge of a sheet reaches the end 206 and continuing until just after the trailing edge of the sheet has passed the end of the nozzle. For example, adhesive can begin flowing from the nozzle end about twenty milliseconds before a sheet reaches the nozzle end and stop about twenty milliseconds after a sheet passes beneath the nozzle end. The flow of adhesive continues without interruption while each sheet except the first sheet of a set of sheets to be bound together has passed the adhesive nozzle. Thus, an uninterrupted line of adhesive is applied to the second and subsequent sheets of the set. While a continuous line of adhesive is preferred, LCU 281 could operate valve 210 intermittently as a sheet passes end 206 to apply two or more stripes of adhesive spaced end to end.

From the foregoing it is apparent that there are very short periods of time during which adhesive flowing from the end 206 of the nozzle is not being applied to copy sheets. In order to avoid accumulation of adhesive in the area beneath the applicator assembly, the tray 108 immediately beneath the nozzle end 206 is provided with a large opening 306 so that adhesive not applied to a sheet of paper passes through the opening. A conduit 308 has one end portion thereof located immediately beneath the opening 306 to receive any adhesive passing therethrough. The conduit has another end portion that is connected to a collection container or bottle 310 located at a suitable remote location in the binder housing. Ultimately the bottle 310 will become filled with adhesive and need to be replaced. When the level of collected adhesive in bottle 310 reaches the upper portion of the bottle it is detected by a sensor comprising an emitter 312 and detector 314. A signal produced by the sensor and furnished to the binder LCU can be used to signal the operator of the need to change the bottle 310. Alternatively, the signal to the LCU can be produced by a weight-sensitive switch 315 that is beneath bottle 310. Switch 315 is normally open and is closed by the weight of adhesive in bottle 310 when the bottle is substantially full.

The various solenoid control valves, switches, emitter-detectors and the like illustrated in FIG. 2 and described hereinbefore are preferably coupled to the logic and control unit 112 for the finisher. This allows the logic and control unit to receive signals and send control signals to the various sensors, valves, etc. in order to control of the operation of the machine.

Operation of the apparatus will now be described. The movement of copy sheets through the binder 44 and formation of booklets has been described previously in connection with FIG. 1 and will not be repeated here. Thus the following description of operation will be concerned principally with the adhesive dispensing system of the present invention and with particular reference to FIGS. 2 and 3 of the drawings.

When the operator selects the binder mode of operation the LCU 281 will immediately verify that the binder is ready for operation. The verification of readiness for operation includes a determination that an adhesive cartridge 274 is present in the binder, that the level of adhesive 272 in the cartridge is sufficiently high to enable binding operations to be carried out, and that the overflow bottle 310 is not full. This is accomplished by the LCU monitoring signals received from switch 280, which verifies the presence of a cartridge 274 in the apparatus, by sensing a signal produced by the emittor-detector 282, 284 which determines that sufficient adhesive is in the cartridge 274, and by monitoring a signal produced by the emittor-detector 312, 314 (or the switch 315) which indicates that the bottle 310 is not full. If these preliminary signals verify that the binder is ready for operation, the LCU will provide a signal to the related copier/duplicator or other apparatus indicating that machine operation can start. If these conditions are not satisfied, a visual or audible signal will be provided to the machine operator indicating the need to provide a new cartridge of adhesive or to empty the overflow bottle 310.

Figure 3:
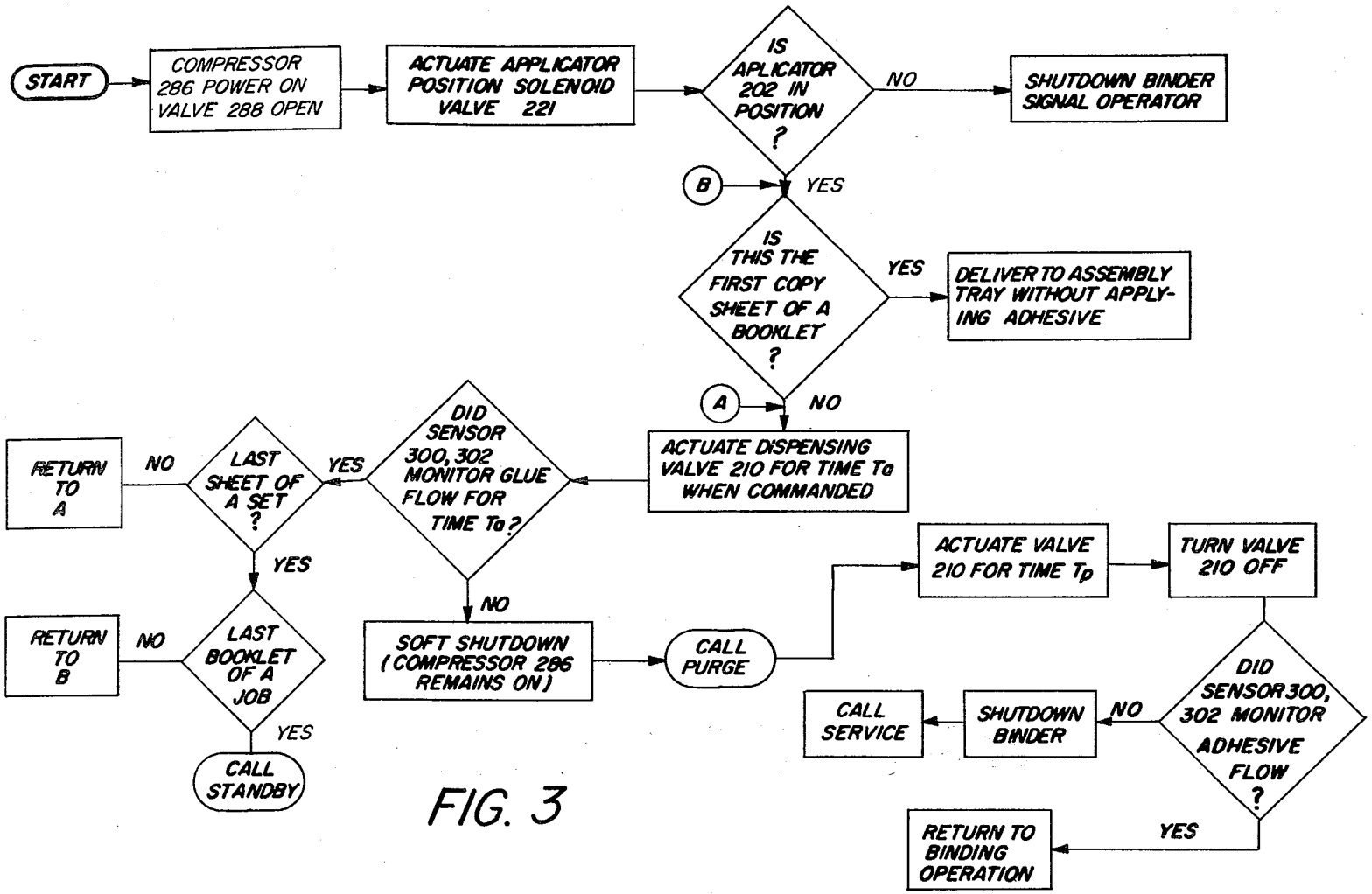
FIG. 3 is a diagram illustrating certain steps in the operation of the adhesive dispensing system of the present invention.

When binder operations are initiated, LCU 281 turns on compressor 286 and opens valve 288 so that the adhesive container 274 becomes pressurized and thus is able to deliver adhesive to the nozzle assembly 202. Air under pressure also is provided from compressor 286 to the solenoid operated valve 221. Valve 221 is actuated by a signal from the LCU 281 to provide air under pressure to the mechanism 220 to drive the nozzle assembly 202 from its storage position shown in dotted lines in FIG. 2 to its operating position shown in solid lines in FIG. 2. This also removes the end 206 from sump 212 and moves the sump to its position shown in FIG. 2. When assembly 202 reaches its operating position, switch 211 is closed and a signal is provided to the LCU 281. As indicated in FIG. 3, if switch 211 is not closed, the binder is shut down and the operator is signalled. If switch 211 signals the LCU that the nozzle assembly is in its operating position, binding operations can continue.

When switch 211 is closed, a timing circuit in the LCU is started. If adhesive valve 210 is not energized within a predetermined time period, the valve 221 is energized to return the end 206 of the applicator to its sump. This will prevent drying out of adhesive in the end 206 which could clog the applicator and prevent subsequent operation of the applicator. The timing circuit is restarted each time the flow of adhesive from the applicator is stopped. The restarting of the timing circuit can be in response to shutting off of valve 210 or by detector 302 sensing the end of adhesive flow from end 206.

At this time in the cycle of operation the sheet transports should begin delivering sheets S of sets seriatim to the receiving tray 108. When a sheet is received in tray 108 it is immediately driven by the puck drive mechanism 144 and nip drives 132, 134 past the adhesive applicator 200. The LCU monitors the flow of copy sheets and determines if the copy sheet being driven past the applicator is the first copy sheet of a set to be bound together or one of the other copy sheets of the set. The LCU will also determine when the last sheet of the last set of sheets has been received and processed by the binder. The use of LCUs for tracking movement of individual sheets and sets of sheets is well known. If the first copy sheet is being delivered past the applicator, no adhesive is applied to the sheet but the sheet is transported directly to the assembly tray 392. For the second and each subsequent sheet of a set, the actuating valve 210 is energized by the LCU just before the sheet begins passing beneath the end 206 of the nozzle assembly and the valve 210 remains open until the trailing end of the sheet passes the end 206. This is the time Ta in FIG. 3. Thus a continuous line of adhesive is applied to the entire length of the sheet adjacent the edge nearest the sheet jogger 126.

When valve 210 is opened to dispense adhesive from end 206, the emittor-detector 300-302 (or other adhesive-flow sensor) will determine if adhesive flows from the nozzle as required. If the sensor does detect the flow of adhesive when called for, the LCU will then determine if adhesive was applied to the last sheet of a set of sheets. If adhesive was not applied to the last sheet of the set, then the adhesive applying routine is repeated, starting at "A" in FIG. 3. When adhesive has been applied to the last sheet of a set, then the LCU determines if adhesive has been applied to the last booklet of the job. If not, then the cycle is repeated, starting at "B" in FIG. 3. When the logic and control unit determines that adhesive has been applied to the last sheet of the last booklet, then the LCU places the binder in a standby or shut-down condition. If no further operations are called for, the LCU returns the adhesive applicator to its storage position, as shown in dotted lines, by operating valve 221.

In the event the adhesive flow sensor comprising emittor 300 and detector 302 does not detect the flow of adhesive from the end 206 of the applicator during an interval of time Ta when the valve 210 is opened to provide adhesive to a sheet, then the LCU places the binder in a "soft" shutdown condition wherein compressor 286 remains on and the adhesive applicator remains in its operative position. The LCU then calls for a purge routine. No sheets S are delivered past the applicator during the purge routine. Instead, the LCU actuates the valve 210 for a predetermned time Tp, such as 60 seconds, and then turns off the dispensing valve 210. During this time Tp the emittor-detector 300-302 provides a signal to the LCU indicating whether adhesive was delivered through the nozzle 206. If adhesive did not flow during this purge routine, the LCU will effect a complete shutdown of the binder and provide a signal to the machine operator indicating the need for service. At this time the applicator 200 is returned to its storage position, end 206 is received in sump 212, and compressor 286 is shut off. In the event adhesive does flow from the nozzle 206 during the purge routine, then the LCU will proceed with the steps necessary to continue binding operations. This may require a rearrangement of copy sheets being provided to the binder, dumping of a partially completed booklet, etc. It is sufficient for the purpose of the present description to understand that the binder will again return to its normal binding operation either automatically or after the intervention of the operator.

The purge routine may be needed for several reasons. For example, if adhesive dries out in applicator 200, including end 206, or in conduit 296, adhesive may not flow when valve 210 is actuated. Also, air may enter conduits 294,296 when the adhesive cartridge is changed. Also, adhesive may fail to flow due to failure of valves 210,221 or 288, or failure of compressor 286 to function properly.

During operation of the binder the logic and control unit will monitor the level of adhesive in cartridge 274. Such monitoring may occur constantly during a cycle of operation or signals from the detectors 284, 314 (or switch 315) can be sampled periodically. In the event no adhesive is detected by detector 284, or if bottle 310 is full of adhesive, as detected by detector 312, the binder enters a "soft" shutdown stage and a signal is provided to the operator indicating the reason for the shutdown. This may require the intervention of the operator to empty bottle 310 or to replace the cartridge 274. In the event cartridge 274 is replaced, it is possible that some air could enter the adhesive line between the cartridge 274 and the nozzle end 206. Therefore, when the LCU detects replacement of the cartridge 274 (by the opening and subsequent closing of switch 280), the binder will enter a "hold" condition and the purge routine described above will be activated for a period of time sufficient to insure that any air between the cartridge supply and applicator end 206 has been purged from the system.

As will be apparent from the foregoing description, the adhesive dispensing system of the present invention is a highly automated system which allows it to be operated by persons with very little training or skill. The system monitors the flow of adhesive from end 206 of the applicator at times when the LCU calls for the flow of adhesive, thereby insuring the application of adhesive to all sheets except the first sheet of the set. Finally, the purge cycle is very desirable because it provides a self-testing routine and self-correcting routine which will eliminate the need for some service calls.

The invention has been described in detail with particular reference to a preferred embodiment thereof, but it will be understood that variations and modifications can be effected within the spirit and scope of the invention.

I claim:

1. An adhesive dispensing apparatus comprising:

an adhesive applicator having a nozzle through which adhesive can be dispensed;

a container for holding a supply of adhesive;

means for pressurizing an upper portion of the container;

means providing a fluid passage from a lower portion of the container to the adhesive applicator;

valve means for controlling the flow of adhesive from the container to the nozzle of the applicator;

means for sensing the presence of adhesive in the container at a level above the lower end of the fluid passage in the container;

means for detecting the flow of adhesive from the nozzle; and control means coupled to the valve means, the sensing means and the detecting means (1) for opening the valve means to dispense adhesive through the applicator only when the sensing means senses the presence of adhesive in the container and (2) for stopping the dispensing apparatus if the detecting means does not detect the flow of adhesive from the nozzle while the valve means is opened.

2. The invention as set forth in claim 1 further comprising means coupled to the control means for detecting the presence of an adhesive cartridge in the apparatus, and the control means being effective to prevent operation of the apparatus unless the cartridge detecting means indicates a cartridge is present.

3. The invention as set forth in claim 1 further comprising a collection container adapted to receive adhesive dispensed from the nozzle but not applied to a work piece, a sensor for detecting the level of adhesive in the container, and the adhesive level sensor being coupled to the control means so that the control means can monitor the level of adhesive in the container and either prevent initial operation of the apparatus or stop operation of the apparatus when the adhesive level sensor detects a predetermined level of adhesive in the bottle.

4. The invention as set forth in claim 1 wherein the control means is effective to initiate a purge cycle when the applicator should be dispensing adhesive but the detecting means fails to detect the flow of adhesive from the applicator, the purge cycle comprising operating the valve means to dispense adhesive from the applicator for a predetermined period of time while monitoring the flow of adhesive by the detecting means.

5. An adhesive dispensing apparatus for applying adhesive to a plurality of sheets or the like, the apparatus comprising:

a container for holding a supply of liquid adhesive;

an adhesive applicator coupled to said container and adapted to dispense adhesive received from the container onto sheets;

valve means for controlling the flow of adhesive from the applicator;

means for detecting the flow of adhesive from the applicator; and logic and control means for operating said valve means to start and stop the flow of adhesive from the applicator and for receiving signals from said detecting means, the logic and control means being effective to temporarily stop normal operation of the system and to initiate a purge cycle when the applicator should be dispensing adhesive but the detecting means fails to detect the flow of adhesive from the applicator, the purge cycle comprising operating the valve means to dispense adhesive from the applicator without applying adhesive to sheets for a predetermined period of time while monitoring the flow of adhesive by the detecting means, and the logic and control means being effective (1) to return to normal operation of the system if the detecting means senses the flow of adhesive during the purge cycle and (2) to shut down operation of the system if the detecting means fails to detect the flow of adhesive during the purge cycle.

6. The invention as set forth in claim 5 further comprising means for sensing movement of a plurality of sheets seriatim relative to the applicator and for producing signals representative thereof, said sensing means being coupled to the logic and control means, and the logic and control means being effective in response to such signals sensing movement of sheets relative to the applicator to operate the applicator for applying adhesive to sheets.

7. The invention as set forth in claim 6 wherein the logic and control means turns the valve on before a sheet reaches the applicator and turns the valve off after a sheet passes the applicator so that some adhesive from the applicator is not applied to sheets, a collection bottle for receiving such adhesive not applied to sheets, and means for signalling the logic and control unit when said bottle is substantially full.

8. Adhesive dispensing apparatus comprising:

an applicator having an adhesive dispensing nozzle;

a container connected to said applicator for holding a supply of adhesive to be dispensed through said nozzle;

flow means for selectively initiating and halting the dispensing of adhesive through said nozzle;

means for detecting (i) the presence of a dispensable quantity of adhesive in the container and (ii) the flowing of adhesive from said nozzle, and for producing signals representative thereof; and means responsive to said signals for conditioning said flow means to initiate dispensing of adhesive only when said container holds a dispensable quantity of such adhesive and to halt dispensing of adhesive following conditioning of said flow means when adhesive is not flowing from said nozzle.

9. The invention as set forth in claim 8 further comprising means for initiating a purge cycle when the applicator should be dispensing adhesive but the detecting means fails to produce a signal representative thereof, the purge cycle comprising operating the flow means to first initiate the flow of adhesive for a predetermined period of time while monitoring the signal produced by the detecting means to determine if adhesive flowed from the applicator and then halting the flow means after the predetermined period of time.

* * * * *